US005451708A

United States Patent [19]

Fujiwara et al.

[11] Patent Number: 5,451,708

[45] Date of Patent: Sep. 19, 1995

[54] AUTOMATIC PLAYER PIANO EQUIPPED WITH MONITORING SYSTEM ON KEY ACTION FOR IMPROVING FIDELITY OF REPRODUCED MUSIC

[75] Inventors: Yuji Fujiwara; Kiyoshi Kawamura; Tsutomu Sasaki, all of Shizuoka, Japan

[73] Assignee: Yamaha Corporation, Japan

[21] Appl. No.: 57,619

[22] Filed: May 5, 1993

[30] Foreign Application Priority Data

May 8, 1992 [JP] Japan ..... 4-143582

[51] Int. Cl.[6] ..... G10F 1/02

[52] U.S. Cl. ..... 84/21; 84/115; 84/462

[58] Field of Search ..... 84/13, 20, 21, 462, 84/115, 601, 626, 633-643

[56] References Cited

U.S. PATENT DOCUMENTS 4,913,026 4/1990 Kaneko et al. ..... 84/21
4,970,928 11/1990 Tamaki ..... 84/21
5,083,491 1/1992 Fields ..... 84/21

FOREIGN PATENT DOCUMENTS 58-169192 10/1983 Japan .
1-239594 9/1989 Japan .

*Primary Examiner*—Steven L. Stephan
*Assistant Examiner*—Patrick J. Stanzione
*Attorney, Agent, or Firm*—Graham & James

[57] ABSTRACT

A controller module associated with a mechanical piano memorizes a plurality sets of parameters produced from detected trajectories of depressed keys in a floppy disk in a recording mode of operation, and restores the trajectories on the basis of the sets of parameters for driving an actuator array associated with a keyboard in a playback mode, thereby exactly reproducing a music without sacrifice of the memory capacity.

12 Claims, 9 Drawing Sheets

AUTOMATIC PLAYER PIANO EQUIPPED WITH MONITORING SYSTEM ON KEY ACTION FOR IMPROVING FIDELITY OF REPRODUCED MUSIC

FIELD OF THE INVENTION

This invention relates to an automatic player piano and, more particularly, to a monitoring system incorporated in the automatic player piano for producing musical information used in a playback of a music.

DESCRIPTION OF THE RELATED ART

A typical example of an automatic player piano is disclosed in Japanese Patent Application laid-open (Kokai) No. 1-239594, and the automatic player piano disclosed therein determines a locus of a depressed key at four points therealong so as to estimate the velocity of the hammer associated with the depressed key.

Another example of the automatic player piano is disclosed in Japanese Patent Application laid-open 58-169192, and a recording system incorporated in the automatic player piano samples strength of each impact with a hammer at predetermined intervals for shrinking the amount of record through selection of impacts larger in variation than a threshold level.

However, a problem is encountered in the prior art automatic player pianos in fidelity of a reproduction. This is because of the fact that the locus is only monitored at four points, and the monitoring system can not discriminate a complex locus of a key in, for example, a half-stroke, repetition of a soft sound or a depression from a half-key position. In other words, these key actions are replaced with standard key actions in the record, and the automatic player piano reproduces sounds of the standard key actions instead of the non-discriminative key actions in the playback mode of operation.

If the locus is monitored at a large number of points, the fidelity may be improved. However, the amount of data information is proportionally increased, and the automatic player piano needs a large memory unit. Such a large memory unit and an associated access system are expensive, and increase the production cost.

The recording system disclosed in Japanese Patent Application laid-open 58-169192 effectively decreases the amount of data codes. However, the recording system can not enhance the fidelity of the music reproduced in the playback mode of operation.

SUMMARY OF THE INVENTION

It is therefore an important object of the present invention to provide an automatic player piano which faithfully reproduces a music without enlarging a memory unit.

To accomplish the object, the present invention proposes to memorize a plurality sets of parameters used for restoration of a trajectory of a key in a playback mode of operation.

In accordance with one aspect of the present invention, there is provided an automatic player piano selectively entering a recording mode and a playback mode of operation, comprising: a) a mechanical piano having a-1) a plurality of keys selectively depressed by a player when the player performs a music, a-2) a plurality of key action mechanisms respectively coupled with the plurality of keys, and selectively driven by the plurality of keys, a-3) a plurality sets of musical wires respectively associated with the plurality of keys, and a-4) a plurality of hammer mechanisms respectively coupled with the plurality of key action mechanisms, and selectively driven by the plurality of key action mechanisms for selectively striking the plurality sets of musical wires; b) a recording system activated in the recording mode of operation, and having b-1) a monitoring means associated with the plurality of keys, and periodically detecting actual positions of the plurality of keys for producing detecting signals indicative of the actual positions of the plurality of keys, a series of actual positions represented by each of the detecting signals being indicative of a trajectory of one of the plurality of keys, b,2) a parameter producing means for producing a plurality sets of parameters from the trajectories of the plurality of keys to be depressed, and b-3) a memory means for storing the plurality sets of parameters; and c) a playback system activated in the playback mode of operation for producing driving signals from the plurality sets of parameters, and causing the plurality of keys to trace the trajectories for reproducing the music.

As shown in FIG. 1, the monitoring means 1 informs the parameter producing means 2 of the trajectories of the keys sequentially depressed, and the parameter producing means 2 produces the plurality sets of parameters through, for example, calculation on the detecting signals. The plurality sets of parameters are stored in the memory means 3.

In accordance with another aspect of the present invention, there is provided an automatic player piano selectively entering a mechanical playing mode and a playback mode of operation, comprising: a) a mechanical piano having a-1) a plurality of keys selectively depressed by a player when the player performs a music in the mechanical playing mode of operation, a-2) a plurality of key action mechanisms respectively coupled with the plurality of keys, and selectively driven by the plurality of keys, a-3) a plurality sets of-musical wires respectively associated with the plurality of keys, and a-4) a plurality of hammer mechanisms respectively coupled with the plurality of key action mechanisms, and selectively driven by the plurality of key action mechanisms for selectively striking the plurality sets of musical wires; b) a memory means storing a plurality sets of parameters for keys selected from the plurality of keys; and c) a playback system activated in the playback mode of operation, and having c-1) a restoring means sequentially accessing the plurality sets of parameters stored in the memory means for determining expected positions of the keys on the basis of the plurality sets of parameters, c-2) a trajectory controlling means for producing driving signals indicative of trajectories restored from the expected positions, and c-3) a driving means responsive to the driving signals for causing the keys to trace the trajectories, thereby reproducing a music.

The playback system 4 is summarized in FIG. 2. The restoring means 5 determines the expected positions of the keys on the basis of the parameters sequentially read out from the memory means, and the trajectory controlling means 6 causes the driving means 7 to drive the keys for tracing the trajectories represented by the expected positions.

In accordance with yet another aspect of the present invention, there is provided an automatic player piano having a recording mode of operation, comprising: a) a mechanical piano having a-1) a plurality of keys selectively depressed by a player when said player performs a music, a-2) a plurality of key action mechanisms respectively coupled with said plurality of keys, and selectively driven by said plurality of keys, a-3) a plurality sets of musical wires respectively associated with said plurality of keys, and a-4) a plurality of hammer mechanisms respectively coupled with said plurality of key action mechanisms, and selectively driven by said plurality of key action mechanisms for selectively striking said plurality sets of musical wires; and b) a recording system having b-1) a monitoring means associated with said plurality of keys, and periodically detecting actual positions of said plurality of keys for producing detecting signals indicative of said actual positions of said plurality of keys, a series of actual positions represented by each of said detecting signals being indicative of a trajectory of one of said plurality of keys, b-2) a parameter producing means for producing a plurality sets of parameters from the trajectories of said plurality of keys to be depressed, and b-3) a memory means for storing said plurality sets of parameters.

BRIEF DESCRIPTION OF THE DRAWINGS

The features and advantages of the automatic player piano according to the present invention will be more clearly understood from the following description taken in conjunction with the accompanying drawings in which.

DESCRIPTION OF THE PREFERRED EMBODIMENT

Figure 1:
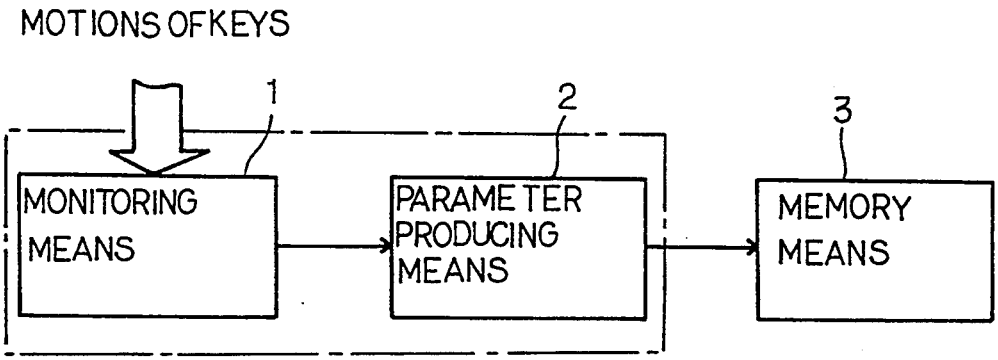
FIG. 1 is a block diagram illustrating the recording system of the present invention.
Figure 2:
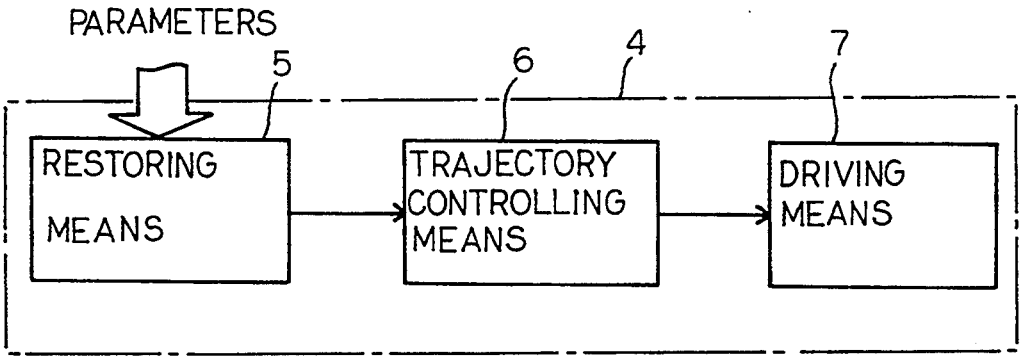
FIG. 2 is a block diagram showing the playback system of the present invention.
Figure 3:
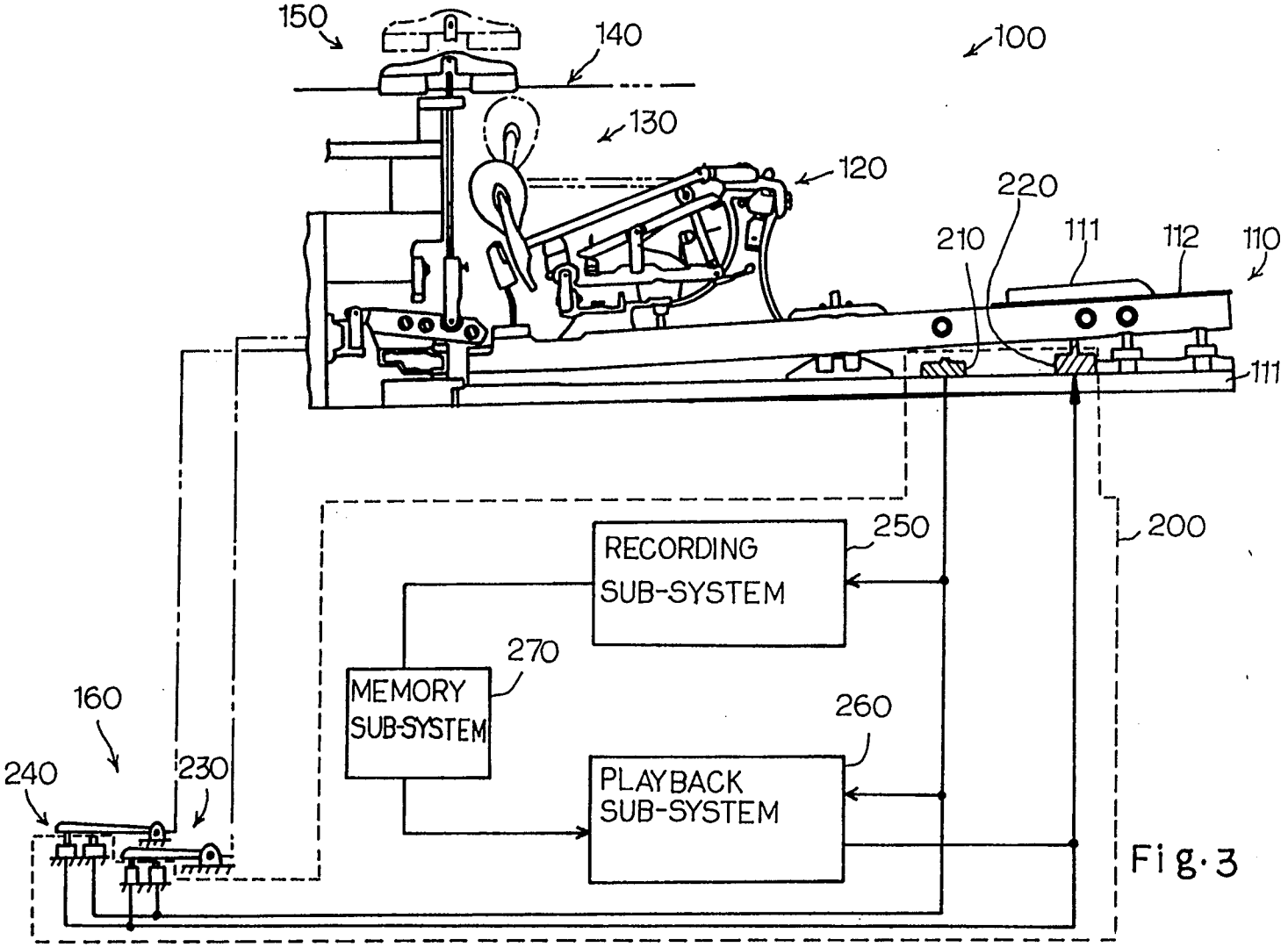
FIG. 3 is a view showing the arrangement of an automatic player piano according to the present invention.

Referring to FIG. 3 of the drawings, an automatic player piano embodying the present invention largely comprises a mechanical piano 100 and an electronic data processing system 200, and selectively enter a mechanically playing mode, a recording mode and a playback mode of operation. The mechanical piano 100 comprises a keyboard 110 mounted on a key bed 111, a plurality of-key action mechanisms 120 selectively driven by the keyboard 110, a plurality of hammer mechanisms 130 respectively associated with the plurality of key action mechanisms, a plurality sets of musical wires 140 respectively associated with the hammer mechanisms 130, a plurality of damper mechanisms 150 respectively associated with the plurality sets of musical wires, and pedal mechanisms 160.

The keyboard 110 has a plurality of black keys 111 and a plurality of white keys 112, and these black and white keys 111 and 112 are respectively associated with the plurality of key action mechanisms 120. Each of the black and white keys 111 and 112 is turnable with respect to a balance key pin when a player depresses the key. The key action mechanisms 120, the hammer mechanisms 130, the sets of musical wires, the damper mechanisms 150 and the pedal mechanisms 160 are well known to a person skilled in the art, and any further description on the mechanical structure thereof is not incorporated hereinbelow for the sake of simplicity.

While a player is depressing the black and white keys 111 and 112 for a music in the mechanically playing mode, the black and white keys 111 and 112 drive the associated key action mechanisms 120, and the key action mechanisms 120 in turn drive the associated hammer mechanisms 130 so that the hammers strike the associated musical wires 140. The musical wires thus struck with the hammers vibrate, and produce sounds. The damper mechanisms 150 leave from the musical wires before striking, and return to the initial positions after the keys are released. When the player steps the right foot on one of the pedal mechanisms 160, the damper mechanisms 150 are held off, and the sounds are prolonged. If the player steps the left foot on another pedal mechanism, a hammer strikes a fewer number of musical wires of the associated set, and the volume of the sound is lessened. The mechanical piano 100 similarly behaves in the recording mode of operation.

The electronic data processing system 200 largely comprises an array of first sensors 210 associated with the keyboard 110, an array of first solenoid-operated actuators 220 also associated with the keyboard 110, an array of second sensors 230 associated with the pedal mechanisms 160, an array of second solenoid-operated actuators 240, a recording sub-system 250 coupled with the array of first sensors 210 as well as with the array of second sensors 230, a playback sub-system 260 coupled with the array of first solenoid-operated actuators 220 and with the array of second solenoid-operated actuators 240, and a memory sub-system 270 coupled with the recording sub-system 250 as well as with the playback sub-system 260.

The array of first sensors 210 is implemented by photo-reflectors, and each photo-reflector has a photo-emitting element paired with a photo-detecting element. While the automatic player piano is staying in the recording mode of operation, the photo-emitting element irradiates light toward the reverse surface of the associated key, and the photo-detecting element converts the reflection from the reverse surface into electric current. The amount of electric current is proportional to the intensity of the reflection, and the intensity of the reflection is dominated by the length of optical path traveled by the light. Therefore, a voltage signal produced from the electric current serves as an analog detecting signal indicative of the distance between the sensor and the associated key.

The array of second sensors 230 is implemented by electrical switches, and the electrical switches are shifted between on-state and off-state depending upon the positions of the associated pedals. The voltage levels at the electrical switches are shaped into square pulse signals PLS, and are supplied to the recording sub-system 250.

Each of the first solenoid-operated actuators 220 and the second solenoid-operated actuators 240 is implemented by a solenoid unit and a plunger, and the plunger is held in contact with the reverse surface of the associated key or the reverse surface of the associated pedal. The array of first solenoid-operated actuators 220 and the array of second solenoid-operated actuators 240 are used in the playback mode of operation. When the solenoid unit is energized, the plunger is retracted into the associated solenoid unit, and pulls down the associated key or the associated pedal as if a player depresses.

Figure 4:
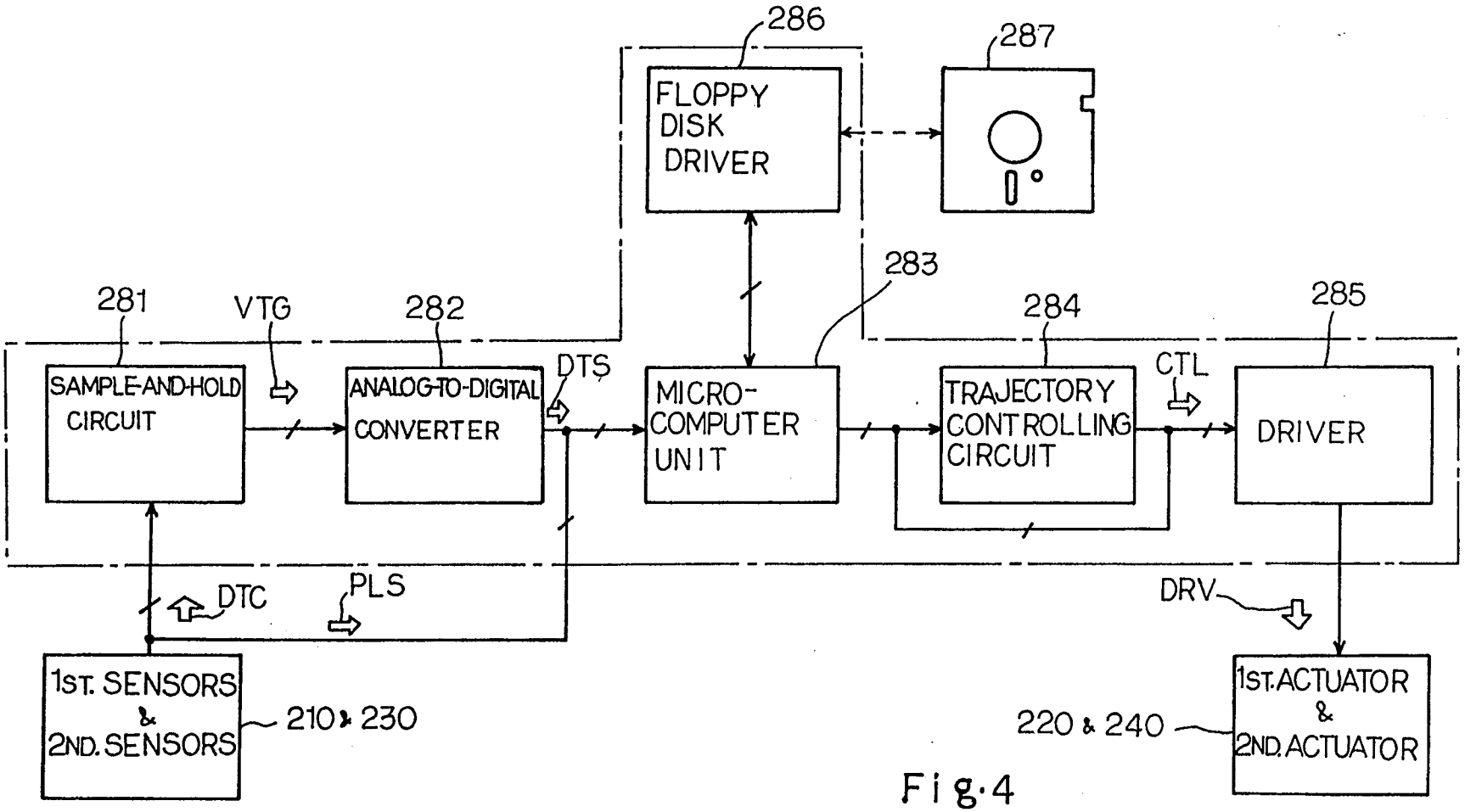
FIG. 4 is a block diagram showing an electronic data processing system incorporated in the automatic player piano.

Although the recording sub-system 250 and the playback sub-system 260 are separated in FIG. 3, the separated boxes are indicative of job sharing between the recording sub-system 250 and the playback sub-system 260, and the recording sub-system 250 and the playback sub-system 260 are implemented by a controller module shown in FIG. 4. The controller module comprises a sample-and-hold circuit 281, an analog-to-digital converter 282, a microcomputer unit 283, a trajectory controlling circuit 284, a driver 285 and a floppy disk driver 286. The microcomputer 283, the sample-and-hold circuit 281, the analog-to-digital converter 282, the floppy disk driver 286 and a floppy disk 287 form in combination the recording sub-system 250, and the microcomputer unit 283, the trajectory controlling circuit 284 and the driver 285 as a whole constitute the playback sub-system 260. Though not shown in the drawings, a microprocessor, a program memory, a working memory and peripheral circuits form the microcomputer unit 283, and the microcomputer unit 283 is communicable with a manipulating board (not shown) where various switch arrays are provided for a player.

The sample-and-hold circuit 281 periodically and sequentially samples the analog detecting signals DTC supplied from the first sensors 210, and produces discrete voltage signals VTG indicative of the discrete voltage levels at the sampling timings. The discrete voltage levels are representative of distances to the keys 111 and 112, and the analog-to-digital converter 282 converts the discrete voltage levels into digital positional signals DTS also representative of the distances to the keys 111 and 112. The digital positional signals DTS and the square pulse signals PLS are supplied to the microcomputer unit 283, and the microcomputer unit 283 executes a program sequence on the digital positional signals DTS and the square pulse signals PLS as will be described hereinlater. Each of the digital positional signals is indicative of a series of detected positions or detected distances, and the series of detected positions represents a trajectory of one of the black and white keys 111 and 112 to be depressed. The microcomputer unit 283 produces a plurality sets of parameters through a predetermined calculation on the series of detected positions, and the plurality sets of parameters are formatted to the third and fourth channels of the MIDI (Musical Instrument Digital Interface) standards together with pieces of pedal information indicative of timings of manipulation on the pedal mechanisms 160. The musical data codes indicative of the parameters and the timings are finally stored in the floppy disk 287 for the playback mode of operation.

The microcomputer unit 283 is further operative to access the musical data codes stored in the floppy disk 287, and restores the trajectories through calculation on the sets of parameters. The microcomputer unit 283 informs the trajectory controlling circuit 284 of the restored trajectories, and the trajectory controlling circuit 284 causes the driver 285 to energize the first actuators 220. While the trajectory controlling circuit 284 are controlling the driver 285, the actual trajectories of the keys 111 and 112 are monitored by the array of first sensors 210, and the trajectory controlling circuit 284 causes the driver 285 to regulate the duty ratios of driving pulse signals DRV to the first actuators 220 so as to match the actual trajectories with the restored trajectories. The driver 285 further drives the second actuators 240 with driving pulse signals DRV under the supervision of the microcomputer unit 283.

Figure 5:
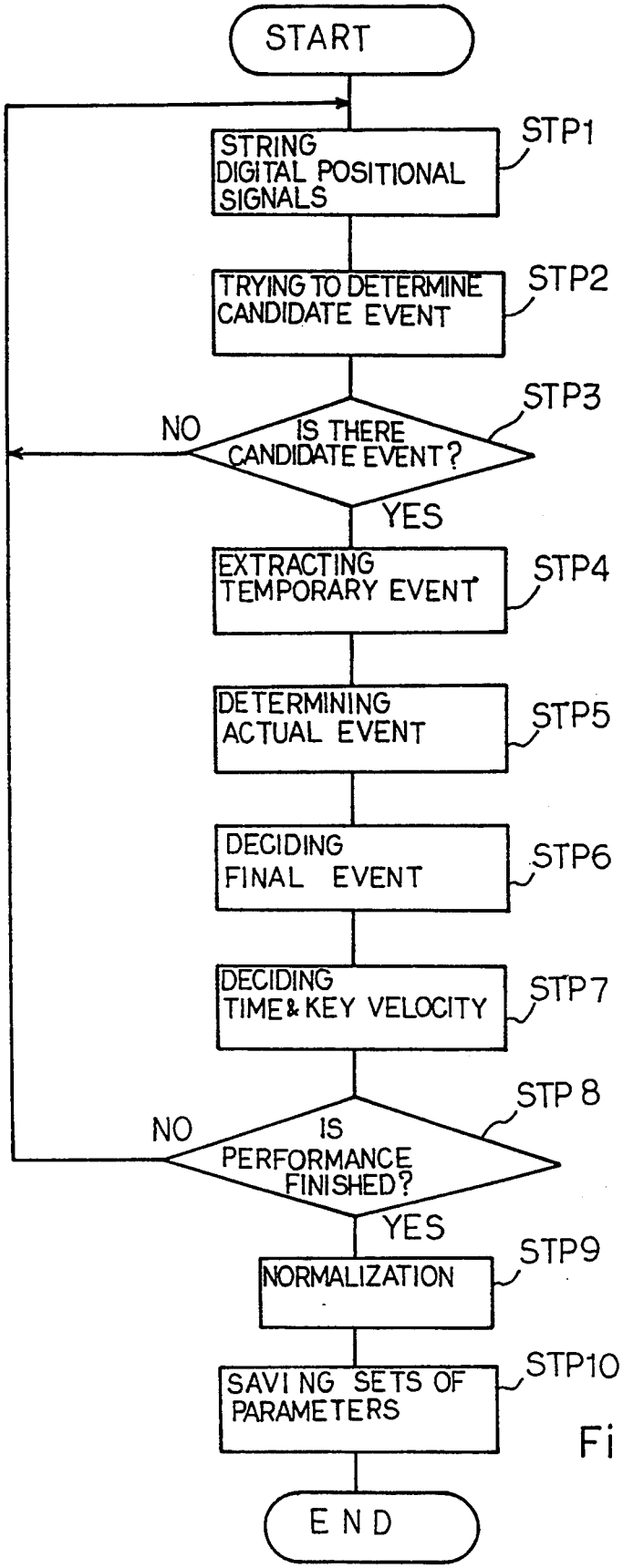
FIG. 5 is a flow chart showing a program sequence for a recording mode of operation executed by a microcomputer unit incorporated in the automatic player piano.
Figure 6:
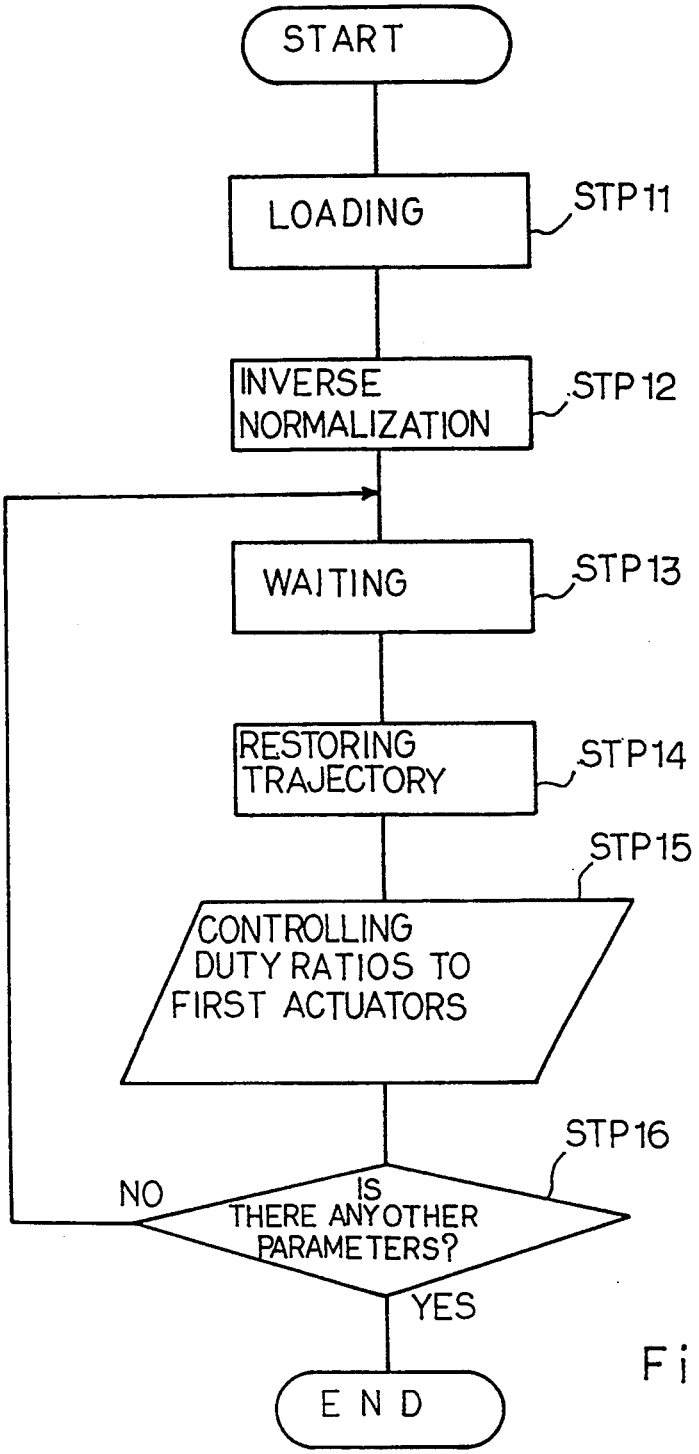
FIG. 6 is a flow chart showing a program sequence for a playback mode of operation executed by the microcomputer unit.

Description is hereinbelow made on program sequences for the recording mode and the playback mode of operation with reference to FIGS. 5 and 6. FIG. 5 illustrates the program sequence for the recording mode, and FIG. 6 shows the program sequence for the playback mode. However, the program sequences do not contain any manipulation on the pedal mechanisms 160 for the sake of simplicity. Assuming now that the automatic player piano enters the recording mode, the player sequentially depresses the black and white keys 111 and 112, and one of the keys 111 and 112 is moving along a trajectory shown in FIG. 7. In this instance, the trajectory is divided into six sections from t0 to t1, from t1 to t2, from t2 to t3, from t3 to t4, from t4 to t5 and from t5 to t6, and the recording sub-system 250 assumes that the sections are represented by respective parabolas. The recording sub-system 250 determines sets of parameters representative of the parabolas, and memorizes the sets of parameters in the memory sub-system 270.

Figure 7:
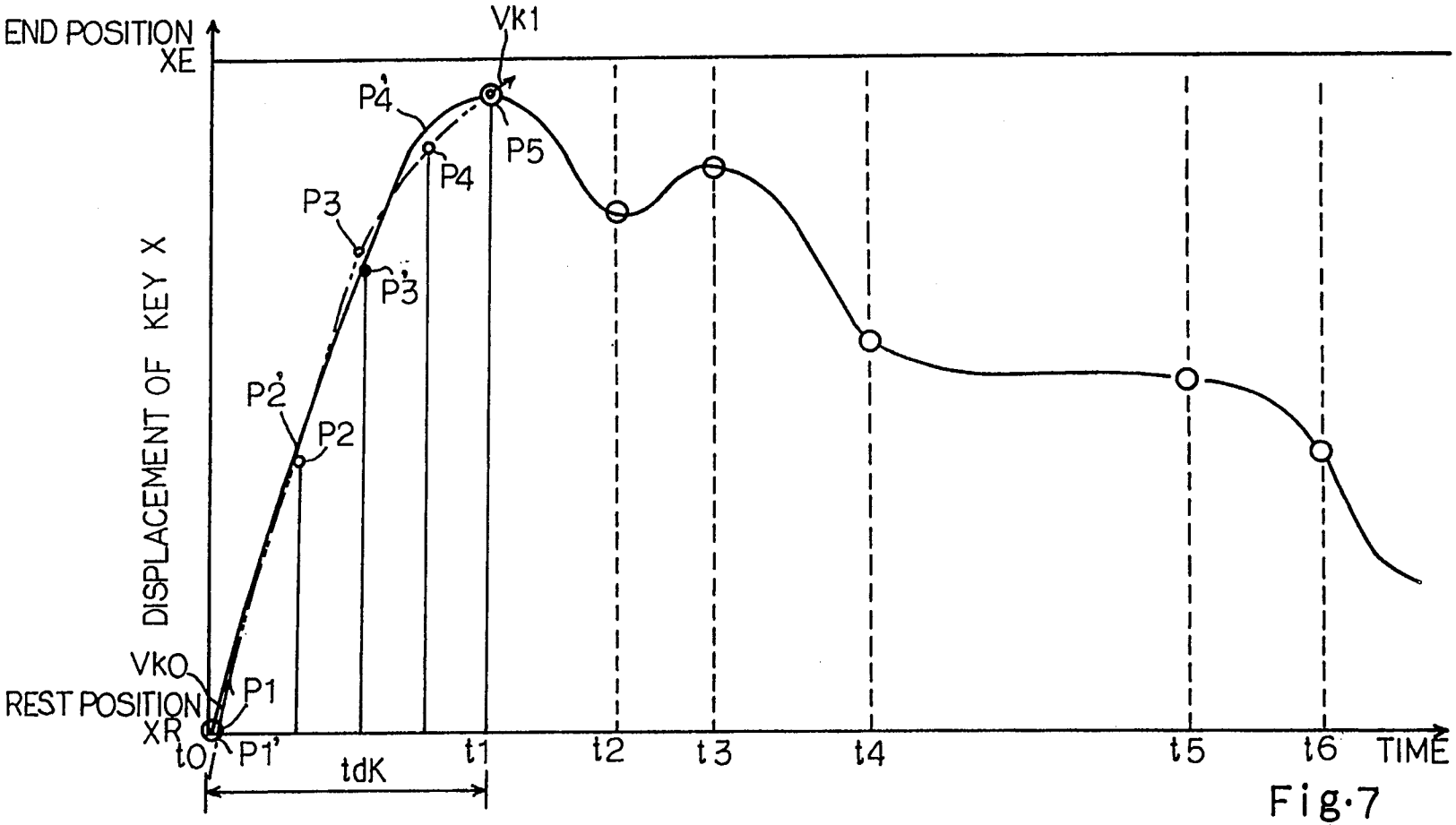
FIG. 7 is a graph showing a trajectory of a key depressed in a performance.

Namely, one of the first sensors 210 is monitoring the key moving along the trajectory shown in FIG. 7, and produces the analog detecting signal DTC for the depressed key. The sample-and-hold circuit 281 samples discrete voltage levels from the analog detecting signal DTC at intervals of 1 millisecond, and the discrete voltage levels are converted to a series of digital positional signals DTS through the analog-got-digital conversion. The series of digital positional signals DTS are temporally stored in the working memory of the microcomputer unit 283 as by step STP1.

Every five digital positional signals DTS is grouped, and form a data block. Firstly, the microcomputer unit 283 tries to determine a candidate event as by step STP2. Namely, the microcomputer unit 283 tries to calculate a representative value or a weighted average value of each data block through the least square method and to determine the orientation of each section. The microcomputer unit 283 further tries to calculate the local maximum or the local minimum. The orientation means whether the key advances to or leaves from the end position, and is determined by comparing the representative value with thresholds indicative of depressing, releasing or resting. The microcomputer unit 283 further compares the representative value of each data group with the representative value of the adjacent data group on either side or the representative values of the adjacent data groups on both sides, and determines which convex function the parabola is classified into. The representative values, the orientation and the local maximum value/the local minimum value form the candidate event.

The microcomputer unit 283 proceeds to step STP3, and decides whether or not a series of digital positional signals have the candidate event. If the answer to step STP3 is given negative, the microcomputer unit 283 returns to step STP1, and reiterates the loop consisting of steps STP 1 to STP 3.

On the other hand, if the answer to step STP3 is given affirmative, the microcomputer unit 283 proceeds to step STP4, and extracts a temporary event. The temporary event consists of a selected orientation and a selected local maximums/a local minimum. While the microcomputer unit 283 is extracting the temporary event, the microcomputer unit 283 takes the traveling speed into account. Namely, if the key is traveling at a standard speed, the microcomputer unit 283 ignores candidate events in 1 to 3 data blocks corresponding to 4 milliseconds to 12 milliseconds as well as a candidate event immediately produced thereafter and identical in polarity. However, if the key is traveling at a low speed, the above mentioned candidate events are not ignored. In FIG. 7, P1′ and P5′0 are indicative of the temporary events, and the interval between the temporary evens P1′ and P5′ are divisible at P2′, P3′ and P4′.

After the extraction of the temporary event, the microcomputer unit 283 proceeds to step STP5, and determines an actual event. Namely, the microcomputer unit 283 selects every other temporary event, and divides a span tdk into four (see FIG. 7). Thereafter, the microcomputer unit 283 decides a parabola as close to boundary points P1 to P5 as possible. The parabola thus decided forms the actual event together with the end position XE, the rest position XR and the local maximums/the local minimums. Even if the local maximums/the local minimums are not on the parabola, the local maximums/the local minimums of the actual event should be identical with those of the temporary event, and it is preferable to use another equation representative of a curve containing the local maximums/the local minimums as constraint points. In FIG. 7, P1 and P5 are indicative of actual events.

The microcomputer unit 283 decides a final event as by step STP6. If the trajectory decided by the actual event terminates without crossing the end position or the rest position, the terminal point forms a part of the final event instead of the end position or the rest position. The other parts of the actual event form parts of the final event.

The microcomputer unit 283 decides time and key velocity at the terminated point as by step STP7, and the initial key velocity Vk0 and the final key velocity Vk1 at the terminated point are expressed by Equations 1.

$$Vk0=2a(-tdk/2)+b,$$

$$Vk1=2a(tdk/2)+b \qquad \text{Equations 1}$$

where a and b are coefficients of $x=at^2+bt+c$ representative of the parabola. In the equation $x=at^2+bt+c$, the origin of t-axis is assumed to be at the mid point between t0 and t1. Upon determination of the initial key velocity Vk0 at time t0 and the final velocity Vk1 at time t1, the microcomputer unit 283 codes the initial velocity Vk0, the time t0, the final velocity Vk1 and the time t1 in the format for the third and fourth channels of the MIDI standards, and are memorized in the working memory as a set of parameters.

The microcomputer unit 283 repeats the sequence for the sections between t1 and t2, t2 and t3, t3 and t4, t4 and t5, and t5 to t6, and determines a plurality sets of parameters.

The microcomputer unit 283 proceeds to step STP8, and checks the working memory to see whether or not the player still performs the music. If the answer to step STP8 is given negative, the microcomputer unit 283 returns to step STP1, and repeats the loop consisting of steps STP1 to STP8 while the player is playing on the keyboard 110.

On the other hand, if the player finishes the performance, any data block newly supplied are indicative of the rest position XR only, and the microcomputer unit 283 normalizes the sets of parameters on the basis of characteristics of a standard mechanical piano already stored and the characteristics of the mechanical piano 100 as by step STP9. The characteristics of the key action mechanisms 120 and the characteristics of the hammer mechanisms 130 are taken into account. Finally, the microprocessor unit 283 transfers the sets of normalized parameters to the floppy disk driver 286, and the floppy disk driver 286 stores musical data codes indicative of the sets of parameters in the floppy disk as by step STP10.

If the automatic player piano according to the present invention enters the playback mode of operation, the microcomputer unit 283 sequentially executes the program sequence shown in FIG. 6. The microcomputer unit 283 sequentially fetches the musical data codes, and loads the musical data codes to the working memory as by step STP11. Then, the microcomputer unit 283 inversely normalizes the sets of parameters as by step STP12, and the sets of inversely normalized parameters are adopted to the mechanical piano unit 100.

The microcomputer unit 283 starts a clock, and monitors the clock to see whether to actuate a first solenoid-operated actuator 220 or not as by step STP13. Assuming now that the clock reaches a time corresponding to the time t0, the microcomputer unit 283 restores the trajectory shown in FIG. 7 from the sets of parameters as by step STP14. A relative displacement xdk from the rest position XR at time tk0 is expressed by Equation 2.

$$xdk=\tfrac{1}{2}\{(Vk1-Vk0)/(tk1-tk0)\}tdk^2+Vk0\times tdk \qquad \text{Equation 2}$$

where Vk1 is the final key velocity at time tk1, Vk0 is the initial key velocity at time tk0 and tdk is lapse of time from time tk0. Since the initial key velocity Vk0 at time tk0 and the final key velocity Vk1 at time tk1 are given by each set of parameters for each section, a series of relative displacements xdk on the trajectory are calculated by changing the lapse of time tdk. The microcomputer unit 283 repeats the calculation for the sections of the trajectory, and determines relative displacements on the trajectory.

The microcomputer unit 283 instructs the trajectory controlling circuit 284 to control the driver 285 for the restored trajectory as by step STP15. In general, the amount of displacement is variable with force exerted to an object, and a solenoid-operated actuator varies the electro-magnetic force together with a duty ratio of a driving pulse signal. Therefore, the trajectory of a key is controllable by changing the duty ratio of the driving pulse signal DRV. The microcomputer unit 283 informs the trajectory controlling circuit 284 of the series of relative displacements, and the trajectory controlling circuit 284 determines the duty ratio for each displacement. The controlling signal CTL indictive of the variable duty ratio is supplied from the trajectory controlling circuit 284 to the driver 285, and the driver 285 produces the drivng pulse signal DRV in accordance with the controlling signal CTL. The driving pulse signal DRV causes the first solenoid-operated actuator 220 associated with the objective key to vary the electro-magnetic force, and the first solenoid-operated actuator 220 pulls the objective key down with the variable force. As a result, the objective key travels along the restored trajectory. While the objective key is travelling along the restored trajectory, the assoicated first sensor 210 monitors the objective key, and feeds back the actual trajectory of the objective key to the microcomputer unit 283. If the actual trajectory is inconsistent with the restored trajectory, the microcomputer unit 283 instructs the trajectory controlling circuit 284 to regulate the controlling signal CTL. The key thus pulled down by the first solenoid-operated actuator 220 drives the assoicated key action mechanism 120 which in turn drives the hammer mechanism 130 for rotation. The hammer mechanism 130 strikes the assoicated set of musical wires, and the musical wires vibrate for reproducing the sound.

The microcomputer unit 283 proceeds to step STP16, and ckecks the working memory to see whether or not a set of parameters is left therein. If the answer to the step STP16 is given negative, the microcomputer unit 283 returns to the step STP13, and repeats the loop consisting of the steps STP13 to STP16. Thus, the black and white keys 111 and 112 are sequentially pulled down by the first solenoid-operated actuators 220, and the automatic player piano performs the music without any human player. When the answer to the step STP16 is given affirmative, the playback is completed, and the microcomputer unit 283 waits the next instruction.

Figure 8:
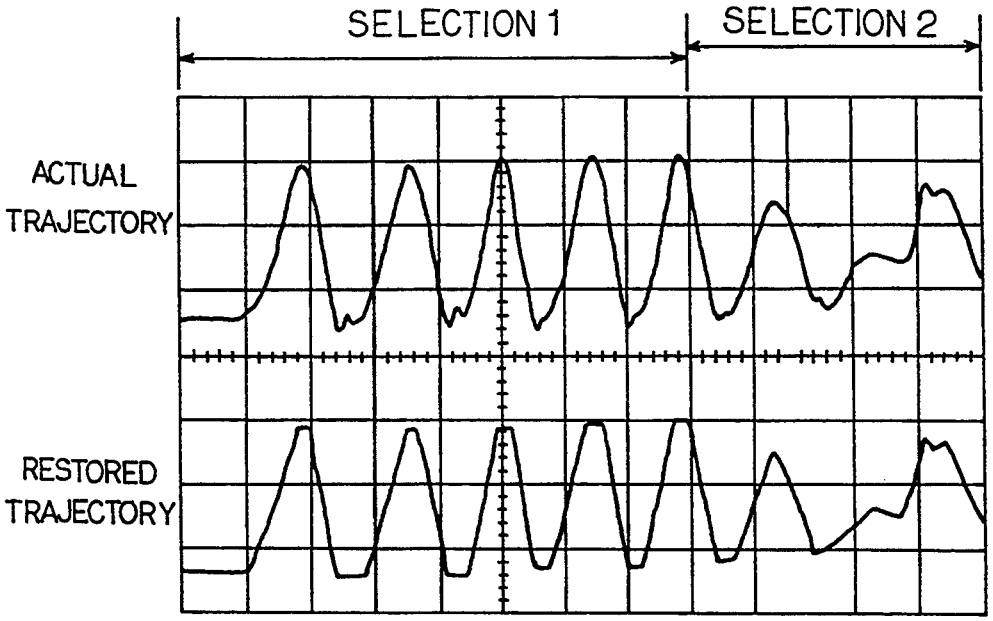
FIG. 8 is a graph showing an actual trajectory and a restored trajectory from sets of parameters.
Figure 9:
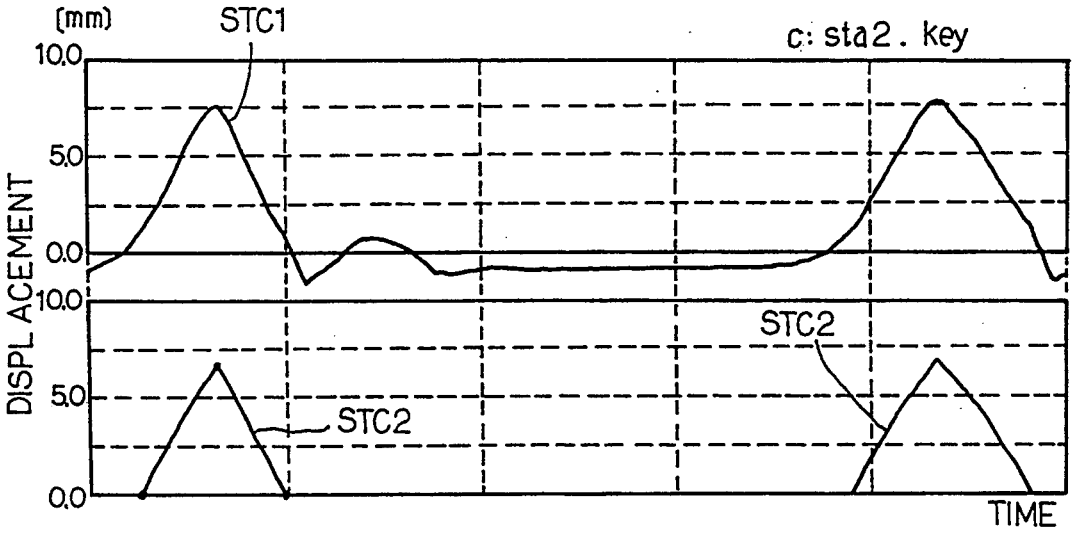
FIG. 9 is a graph showing a key motion performed in staccato and a restored trajectory from normalized parameters.
Figure 10:
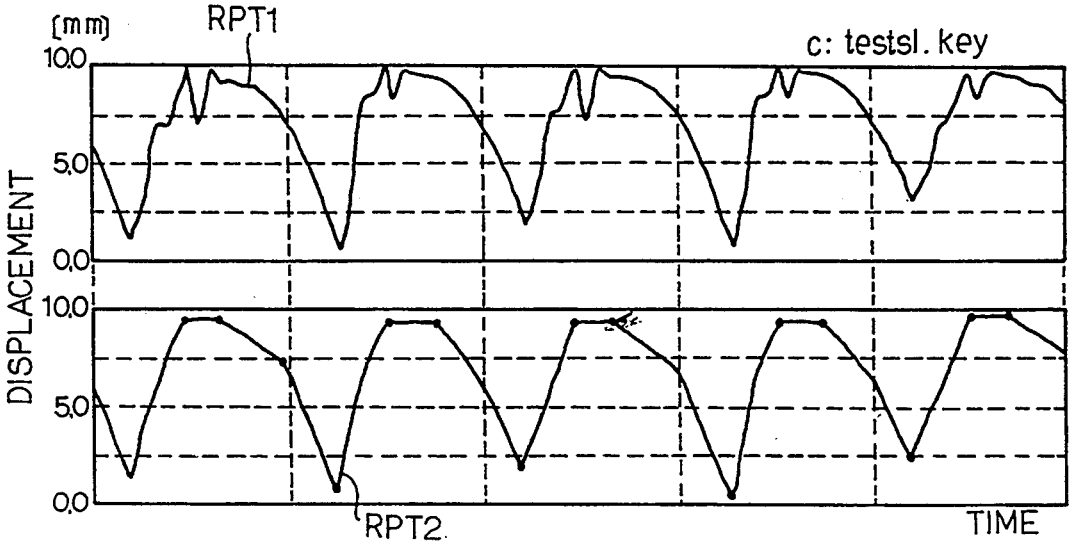
FIG. 10 is a graph showing a key motion of in repeated depression and a restored trajectory from normalized parameters.
Figure 11:
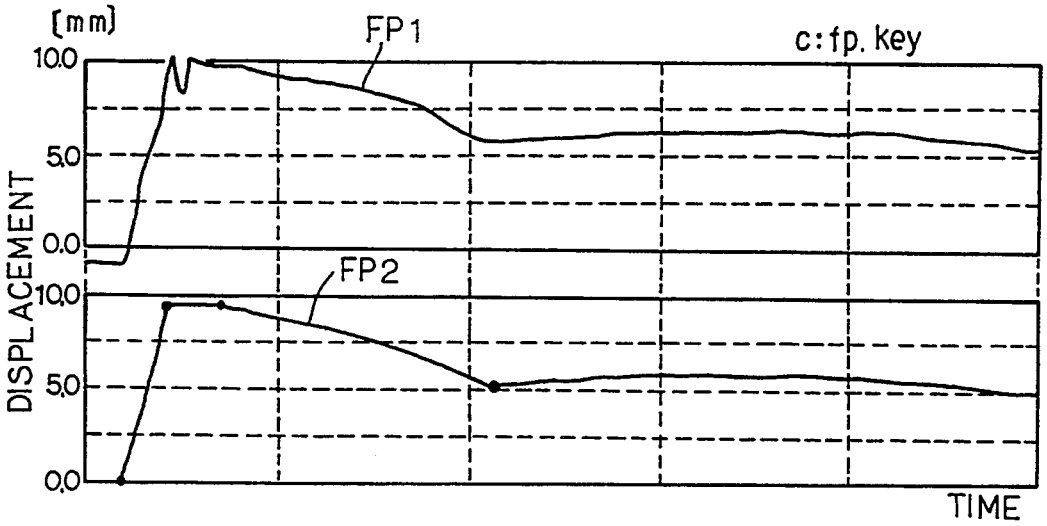
FIG. 11 is a graph showing a key motion in a forte piano and a restored trajectory from normalized parameters.
Figure 12:
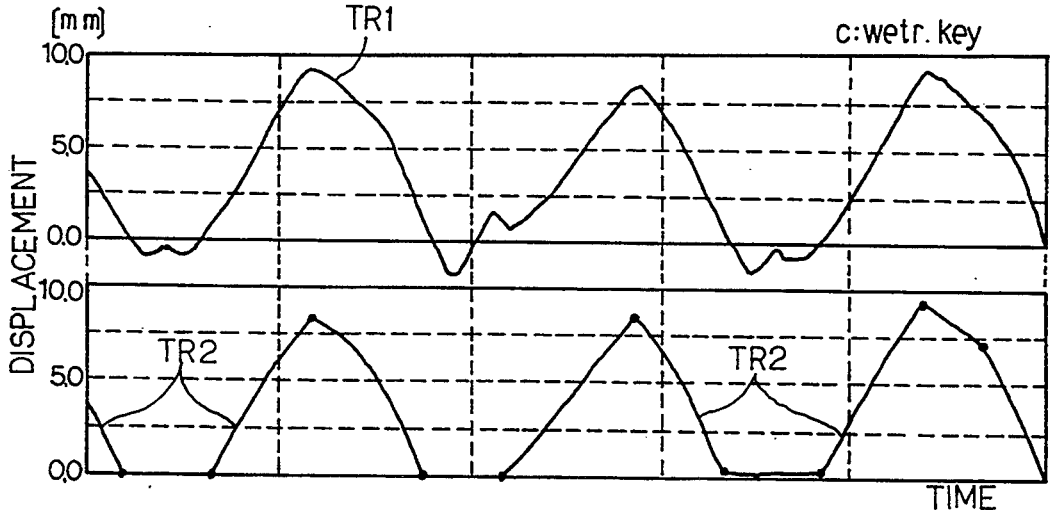
FIG. 12 is a graph showing a key motion in a trill and a restored trajectory from normalized parameters.

As will be appreciated from the foregoing description, the automatic player piano according to the present invention memorizes trajectories of depressed keys as plurality sets of parameters, and the amount of musical data is decreased without sacrifice of the fidelity. For example, FIG. 8 shows an actual trajectory and a restored trajectory from sets of parameters. While a player repeats a forte on a key, the key is moved along the actual trajectory in section 1. A plurality sets of parameters are produced from the key motion, and the trajectory of the key is restored from the sets of parameters as shown below the actual trajectory. Similary, while a player irregulary repeats, the key is moved along the actual trajectory in section 2, and restored trajectory is analogous to the actual trajectory.

FIGS. 9 to 12 illustrate restored trajectories from normalized parameters. When a player performs a staccato, the actual key motion is represented by Plots STC1 in FIG. 9, and Plots STC2 stand for the restored trajectory from normalized parameters. The key returns before reaching end position, and the restored trajectory from the normalized parameters indicates such a half stroke. A key motion in repetition of a key is represented by Plots RPT1, and Plots RPT2 represents a restored trajectory from normalized parameters. In the actual key motion, the key is depressed before returning to the rest position, and the restored trajectory also indicates the particular features. Thus, Plots STC2 and RPT2 well represent respective key motions which are not of a full-stroke.

If a player performs a fortepiano on a key, the key is moved along Plots FP1, and the restored trajectory from normalized parameters is represented by Plots FP2. The fortepiano requests the player to rapidly return the associated damper to the sets of musical wires for partially muting sound and to keep the key halfway to the rest position. The trajectory indicated by Plots FP2 represents the particular features of the fortepiano. Finally, while a player performs a trill on a key, the key traces Plots TR1, and the restored trajectory from normalized parameters is labeled with TR2. Comparing the actual trajectories with the restored trajectories, it is understood that the sets of parameters allow the automatic player piano to restore the key motions.

Although particular embodiments of the present invention have been shown and described, it will be obvious to those skilled in the art that various changes and modifications may be made without departing from the spirit and scope of the present invention. For example, the present invention is applicable to any musical instrument for recording and/or reproducing a series of sounds variable with the motion of a manipulator. Moreover, the recording sub-system may deleted from an automatic player piano, and the automatic player piano is available for a mechanical playing mode and a playback mode only. In this instance, parameters have been already stored in a recording medium, and the recording medium is supplied from an external system through a communication system. Furthermore, yet another automatic player piano may be constituted by a mechanical piano and an electronic system for a recording mode only, and the parameters are supplied to an external system. If the format of the parameters is standardized, the automatic player piano for the playback mode only and the automatic player piano for the recording mode only are extremely valuable.

What is claimed is:

1. An automatic player piano selectively entering a recording mode and a playback mode of operation, comprising:

a) a mechanical piano having a-1) a plurality of keys selectively depressed by a player when said player performs a music, a-2) a plurality of key action mechanisms respectively coupled with said plurality of keys, and selectively driven by said plurality of keys, a-3) a plurality of sets of musical wires respectively associated with said plurality of keys, and a-4) a plurality of hammer mechanisms respectively coupled with said plurality of key action mechanisms, and selectively driven by said plurality of key action mechanisms for selectively striking said plurality of sets of musical wires;

b) a recording system activated in said recording mode of operation, and having b-1) a monitoring means associated with said plurality of keys, and periodically detecting actual positions of said plurality of keys for producing detecting signals indicative of said actual positions of said plurality of keys, a series of actual positions represented by each of said detecting signals being indicative of a trajectory of one of said plurality of keys, b-2) a parameter producing means for producing a plurality of sets of parameters respectively indicative of the trajectories of said plurality of keys depressed by said player, and b-3) a memory means for storing said plurality of sets of parameters; and c) a playback system activated in said playback mode of operation for producing driving signals from said plurality of sets of parameters, and causing said plurality of keys to trace said trajectories for reproducing said music.

2. An automatic player piano as set forth in claim 1, in which said parameter producing means divides each of said trajectories into a plurality of sections, and predetermined sets of parameters selected from said plurality of sets of parameters are respectively associated with said sections.

3. An automatic player piano as set forth in claim 2, in which said plurality of sections are respectively represented by parabolas.

4. An automatic player piano as set forth in claim 3, in which each of said predetermined sets of parameters is representative of an initial time at the starting point of the associated section, an initial key velocity at said initial time, a final time at the end point of said associated section and a final key velocity at said final time.

5. An automatic player piano as set forth in claim 4, in which said initial key velocity and said final key velocity are represented by the following equations $$Vk0=2a(-tdk/2)+b\ ,\ Vk1=2a(tdk/2)+b$$

where Vk0 and Vk1 are said initial key velocity and said final key velocity, tdk is lapse of time from said initial time to said final time, and a and b are coefficients of an equation $x=at^2+bt+c$ representative of a parabola for one of said sections, t being measured from the mid point between said initial time and said final time.

6. An automatic player piano as set forth in claim 1, in which said monitoring means detects said actual positions at intervals of 1 millisecond.

7. An automatic player piano selectively entering a mechanical playing mode and a playback mode of operation, comprising:

a) a mechanical piano having a-1) a plurality of keys selectively depressed by a player when said player performs a music in said mechanical playing mode of operation, a-2) a plurality of key action mechanisms respectively coupled with said plurality of keys, and selectively driven by said plurality of keys, a-3) a plurality of sets of musical wires respectively associated with said plurality of keys, and a-4) a plurality of hammer mechanisms respectively coupled with said plurality of key action mechanisms, and selectively driven by said plurality of key action mechanisms for selectively striking said plurality of sets of musical wires;

b) a memory means storing a plurality of sets of parameters for keys selected from said plurality of keys; and c) a playback system activated in said playback mode of operation, and having c-1) a restoring means sequentially accessing said plurality of sets of parameters stored in said memory means for determining expected positions of said keys on the basis of said plurality of sets of parameters, c-2) a trajectory controlling means for producing driving signals indicative of trajectories restored from said expected positions, and c-3) a driving means responsive to said driving signals for causing said keys to trace said trajectories, thereby reproducing a music.

8. An automatic player piano as set forth in claim 7, in which each of said trajectories is divided into a plurality of sections, and predetermined sets of parameters selected from said plurality of sets of parameters are respectively associated with said sections.

9. An automatic player piano as set forth in claim 8, in which said plurality of sections are respectively represented by parabolas.

10. An automatic player piano as set forth in claim 9, in which each of said predetermined sets of parameters is representative of an initial time at the starting point of the associated section, an initial key velocity at said initial time, a final time at the end point of said associated section and a final key velocity at said final time.

11. An automatic player piano as set forth in claim 10, in which each relative position of the section is calculated by the following equation $$xdk=\tfrac{1}{2}\{Vk1-Vk0)/(tk1-tk0)\}tdk^2+Vk0\times tdk$$

where xdk is said relative-position, Vk1 is said final key velocity, Vk0 is said initial key velocity, tk0 is said initial time, tk0 is said final time and tdk is a relative difference of time from said initial time.

12. An automatic player piano having a recording mode of operation, comprising:

a) a mechanical piano having a-1) a plurality of keys selectively depressed by a player when said player performs a music, a-2) a plurality of key action mechanisms respectively coupled with said plurality of keys, and selectively driven by said plurality of keys, a-3) a plurality of sets of musical wires respectively associated with said plurality of keys, and a-4) a plurality of hammer mechanisms respectively coupled with said plurality of key action mechanisms, and selectively driven by said plurality of key action mechanisms for selectively striking said plurality of sets of musical wires; and b) a recording system having b-1) a monitoring means associated with said plurality of keys, and periodically detecting actual positions of said plurality of keys for producing detecting signals indicative of said actual positions of said plurality of keys, a series of actual positions represented by each of said detecting signals being indicative of a trajectory of one of said plurality of keys, b-2) a parameter producing means for producing a plurality of sets of parameters respectively indicative of the trajectories of said plurality of keys depressed by said player, and b-3) a memory means for storing said plurality of sets of parameters.

* * * * *